US008958728B2

(12) United States Patent
Hotani

(10) Patent No.: US 8,958,728 B2
(45) Date of Patent: Feb. 17, 2015

(54) IMAGE FORMING APPARATUS AND TONER CASE

(71) Applicant: KYOCERA Document Solutions Inc., Osaka (JP)

(72) Inventor: Tomoya Hotani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/960,730

(22) Filed: Aug. 6, 2013

(65) Prior Publication Data

US 2014/0044459 A1 Feb. 13, 2014

(30) Foreign Application Priority Data

Aug. 8, 2012 (JP) ..... 2012-175601

(51) Int. Cl.
*G03G 15/08* (2006.01)

(52) U.S. Cl.
CPC ..... *G03G 15/0832* (2013.01); *G03G 15/0865* (2013.01); *G03G 15/0837* (2013.01)
USPC ..... 399/263

(58) Field of Classification Search
CPC ..... G03G 15/0837
USPC ..... 399/263, 264, 120
See application file for complete search history.

(56) References Cited

U.S. PATENT DOCUMENTS

| | | | | |
|---|---|---|---|---|
| 7,747,200 | B2 * | 6/2010 | Eto | 399/263 |
| 2008/0038023 | A1 | 2/2008 | Eto | |
| 2008/0170888 | A1 * | 7/2008 | Eto et al. | 399/263 |
| 2008/0170889 | A1 * | 7/2008 | Eto et al. | 399/263 |
| 2008/0170890 | A1 * | 7/2008 | Nishimura et al. | 399/263 |
| 2013/0170873 | A1 * | 7/2013 | Carter et al. | 399/263 |
| 2013/0195510 | A1 * | 8/2013 | Eto | 399/258 |

FOREIGN PATENT DOCUMENTS

| | | | |
|---|---|---|---|
| JP | 2004-205759 | A | 7/2004 |
| JP | 2008-040377 | A | 2/2008 |
| JP | 2010-175804 | A | 8/2010 |

OTHER PUBLICATIONS

An Office Action; "Notice of Reasons for Rejection," issued by the Japanese Patent Office on Jul. 15, 2014, which corresponds to Japanese Patent Application No. 2012-175601 and is related to U.S. Appl. No. 13/960,730.

* cited by examiner

*Primary Examiner* — Walter L Lindsay, Jr.
*Assistant Examiner* — Rodney Bonnette
(74) *Attorney, Agent, or Firm* — Studebaker & Brackett PC

(57) ABSTRACT

An image forming apparatus includes a toner case and an attachment member. The toner case has a transmission coupling. The attachment member has a drive coupling, an advance/retreat member and a lever. The advance/retreat member advances and retreats between a first position and a second position being closer to the drive coupling than the first position. The lever is moved between a first operation position to move the advance/retreat member to the first position and a second operation position to move the advance/retreat member to the second position. When the toner case is attached to the attachment member, the toner case engages with the advance/retreat member. In this time, when the lever is moved from the first operation position to the second operation position, the toner case together with the advance/retreat member approaches to the drive coupling and the transmission coupling is connected to the drive coupling.

20 Claims, 15 Drawing Sheets

IMAGE FORMING APPARATUS AND TONER CASE

INCORPORATION BY REFERENCE

This application is based on and claims the benefit of priority from Japanese Patent application No. 2012-175601 filed on Aug. 8, 2012, the entire contents of which are incorporated herein by reference.

BACKGROUND

The present disclosure relates to an image forming apparatus and a toner case attached to the image forming apparatus.

An electrographic image forming apparatus carries out the development process by supplying a toner (a developer) from a development device to an electrostatic latent image formed on a surface of a photosensitive drum or the like. The toner used in such development process is supplied from a toner case, such as a toner container or an intermediate hopper, to the development device.

The above-mentioned toner case includes a case main body having a discharge port discharging the toner, a rotating member (e.g. a stirring paddle or a conveying screw) rotatably installed in the case main body and a transmission coupling connected to the rotating member. When a drive coupling connected to a drive source, such as a motor, is connected to the above-mentioned transmission coupling, the rotating member rotates.

For example, there is a configuration that the drive coupling is connected to the transmission coupling accompanying to an operation of attaching the toner case to an attachment member.

Because the toner case is consumable, it is preferable to simplify the configuration as much as possible. However, in the above-mentioned configuration, because a pressuring piece pressuring and moving back the drive coupling is provided in the toner case, according to this, the configuration of the toner case is complicated.

SUMMARY

In accordance with an embodiment of the present disclosure, an image forming apparatus includes a toner case and an attachment member. The toner case contains a toner. The toner case is attachably/detachably installed to the attachment member. The toner case has a case main body, one or more rotating members and a transmission coupling. The case main body has a discharge port discharging the toner. The rotating members are rotatably installed in the case main body. The transmission coupling is connected to the rotating members. The attachment member has a drive coupling, an advance/retreat member and a lever. The drive coupling is connected to a drive source. The advance/retreat member is configured to advance and retreat between a first position positioned at a distance from the drive coupling and a second position being closer to the drive coupling than the first position. The lever is configured to move between a first operation position moving the advance/retreat member to the first position and a second operation position moving the advance/retreat member to the second position. When the toner case is attached to the attachment member, the toner case engages with the advance/retreat member. When the lever is moved from the first operation position to the second operation position in a state that the toner case is attached to the attachment member, the toner case is moved together with the advance/retreat member in a direction approaching to the drive coupling and the transmission coupling is connected to the drive coupling.

Furthermore, in accordance with an embodiment of the present disclosure, a toner case contains a toner, is attachably/detachably installed to an attachment member and is installed together with the attachment member in an image forming apparatus. The toner case includes a case main body, one or more rotating members and a transmission coupling. The case main body has a discharge port discharging the toner. The rotating members are rotatably installed in the case main body. The transmission coupling is connected to the rotating members. The attachment member has a drive coupling, an advance/retreat member and a lever. The drive coupling is connected to a drive source. The advance/retreat member is configured to advance and retreat between a first position positioned at a distance from the drive coupling and a second position being closer to the drive coupling than the first position. The lever is configured to move between a first operation position moving the advance/retreat member to the first position and a second operation position moving the advance/retreat member to the second position. When the toner case is attached to the attachment member, the toner case engages with the advance/retreat member. When the lever is moved from the first operation position to the second operation position in a state that the toner case is attached to the attachment member, the toner case is moved together with the advance/retreat member in a direction approaching to the drive coupling and the transmission coupling is connected to the drive coupling.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
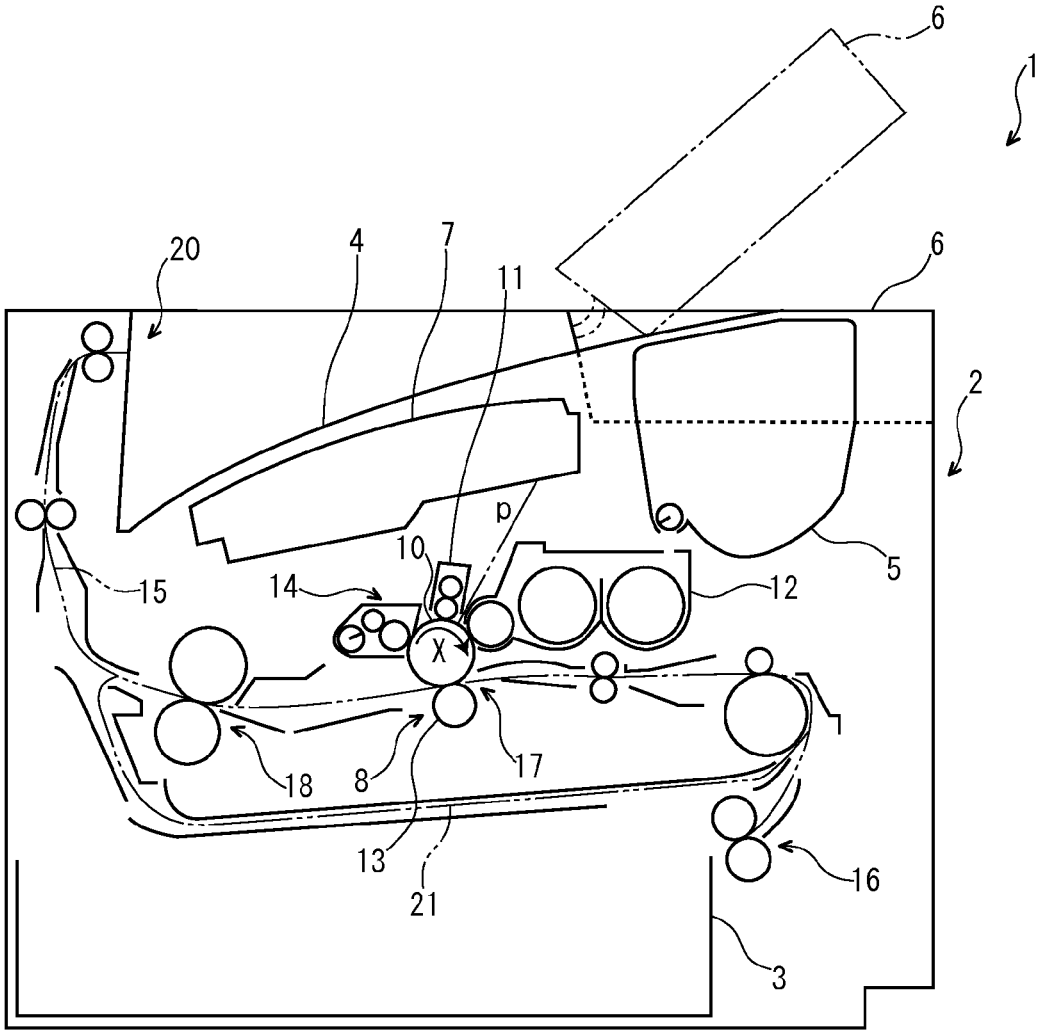
FIG. 1 is a schematic diagram schematically showing a printer according to an embodiment of the present disclosure.

First, with reference to FIG. 1, the entire structure of an electrographic printer 1 (an image forming apparatus) will be described. FIG. 1 is a schematic diagram schematically showing the printer according to an embodiment of the present disclosure. Hereinafter, it will be described so that the front side of the printer 1 is positioned at the right-hand side of FIG. 1.

The printer 1 includes a box-formed printer main body 2. In a lower part of the printer main body 2, a sheet feeding cartridge 3 configured to store sheets (not shown) is installed and, in a top face of the printer main body 2, a sheet ejecting tray 4 is formed. In front of the sheet ejecting tray 4, a toner container (a toner case) 5 is attached and an openable/closable upper cover (a cover) 6 is attached so as to cover an upper part and a front part of an outside face of the toner container 5.

In an upper part of the printer main body 2, an exposure device 7 composed of a laser scanning unit (LSU) is installed below the sheet ejecting tray 4. Below the exposure device 7, an image forming part 8 is installed. In the image forming part 8, a photosensitive drum 10 as an image carrier is rotatably installed. Around the photosensitive drum 10, a charger 11, a development device (an attachment member) 12, a transfer roller 13 and a cleaning device 14 are located along a rotating direction (refer to arrow X in FIG. 1) of the photosensitive drum 10.

In the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing device 18 is positioned. At a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 20 to the sheet ejecting tray 4. Toner remained on the photosensitive drum 10 is collected by the cleaning device 14.

Figure 2:
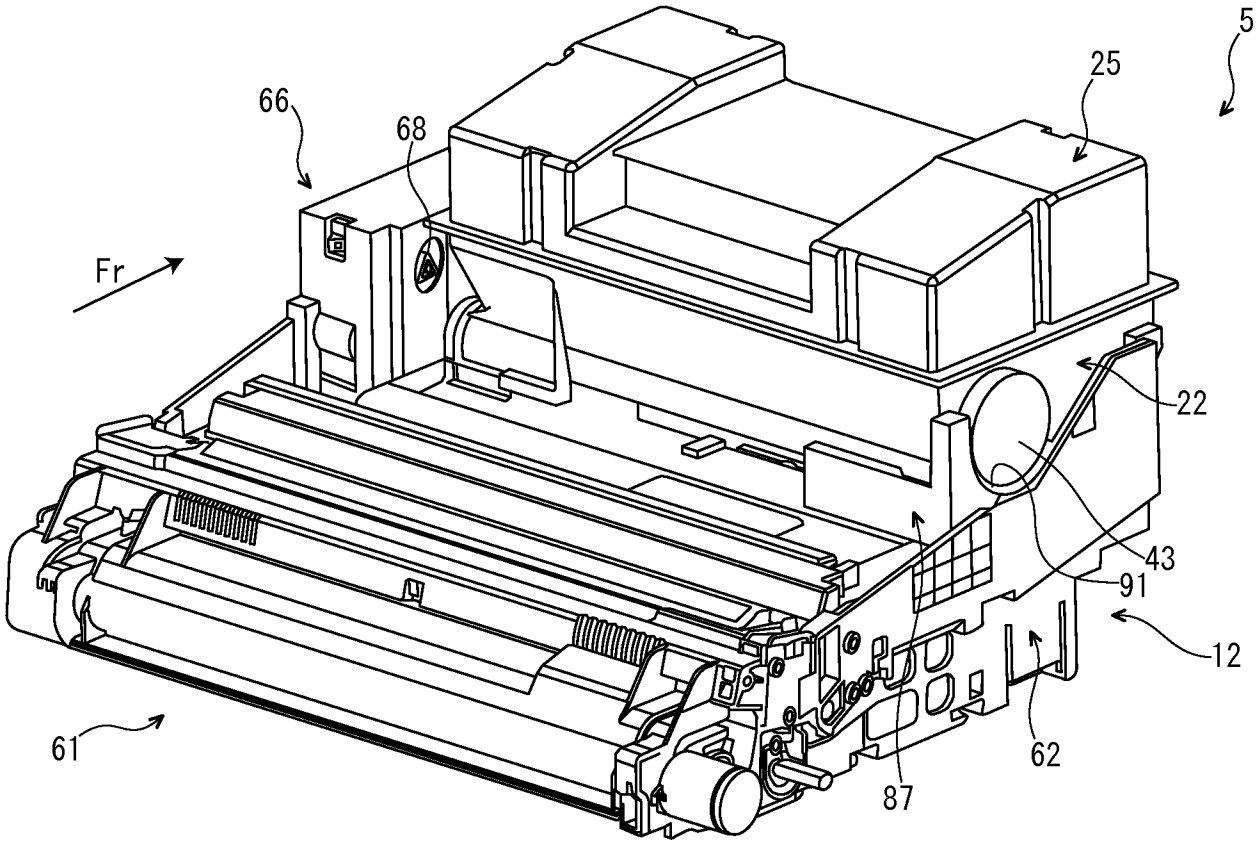
FIG. 2 is a perspective view showing the printer in a situation, in which a toner container is attached to the development device, according to the embodiment of the present disclosure.
Figure 3:
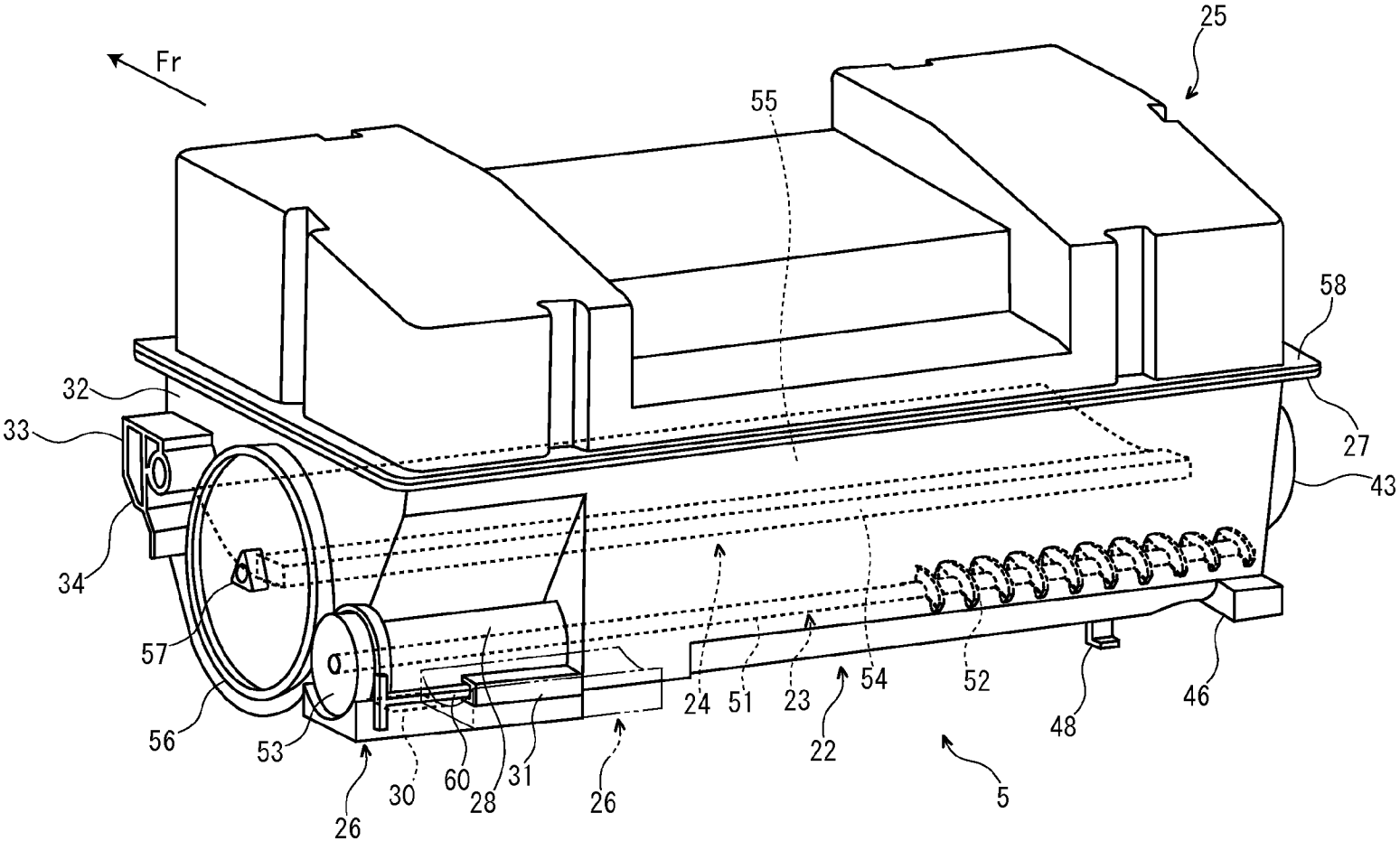
FIG. 3 is a back perspective view showing the toner container in the printer according to the embodiment of the present disclosure.

Next, with reference to FIGS. 2-4, the toner container 5 will be described in detail. Arrow Fr put on each figure indicates the front side of the printer 1 (FIG. 5 and more are also illustrated similarly). In FIGS. 2 and 3, an arrangement relation in left and right direction on the figure is converse to a realistic arrangement relation in actual left and right direction. That is, the right-hand sides on FIGS. 2 and 3 are actual left-hand sides and the left-hand sides on FIGS. 2 and 3 are actual right-hand sides.

The toner container 5 contains the toner. As shown in FIG. 2, the toner container 5 is attachably/detachably installed to the development device 12. For instance, when the toner in the toner container 5 is used up, the toner container 5 can be replaced.

As shown in FIG. 3 and other figure, the toner container 5 includes a box-formed case main body 22 with a opened top face, a conveying screw (a rotating member) 23, a stirring paddle (another rotating member) 24, a covering body 25 and a shutter 26. The conveying screw 23 is installed in a lower rear part of the case main body 22. The stirring paddle 24 is installed near a center part of the case main body 22. The covering body 25 covers the top face of the case main body 22. The shutter 26 is installed to a right bottom end part of the case main body 22.

The case main body 22 is formed in an extended-shape in left and right directions. On the circumference of a top end of the case main body 22, a main body side flange 27 is formed. At the right bottom end part of the case main body 22, a cylinder-formed discharge duct 28 is protruded. In a bottom part of the discharge duct 28, a discharge port 30 configured to discharge the toner is bored. To both front and rear parts of the discharge duct 28, main body side rails 31 extending in the left and right directions are attached. In a front end part of a right end wall 32 of the case main body 22, a first protruded piece 33 is protruded. In a front part of the first protruded piece 33, a first inclination 34 inclined backward and downward is formed.

Figure 4:
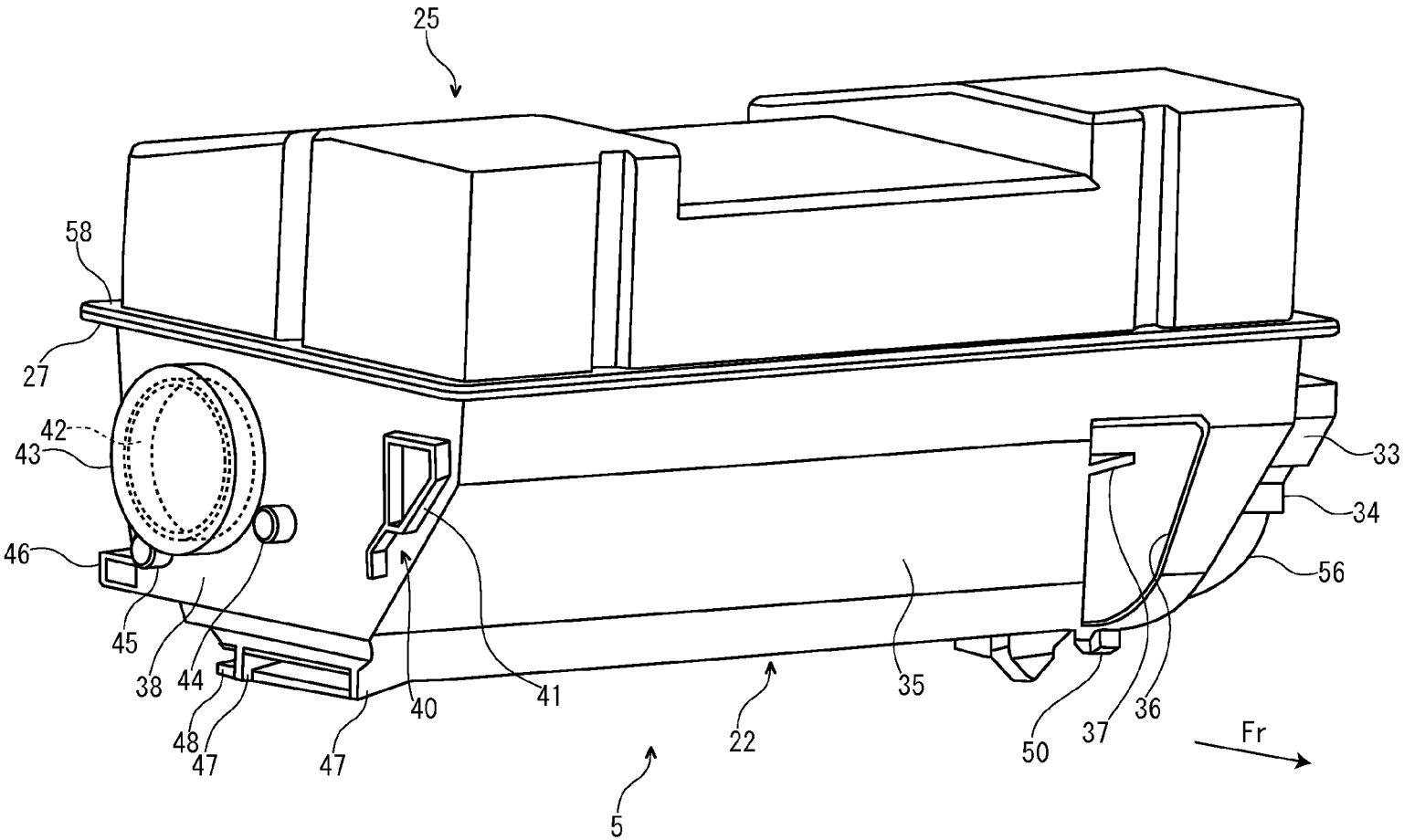
FIG. 4 is a front perspective view showing the toner container in the printer according to the embodiment of the present disclosure.
Figure 5:
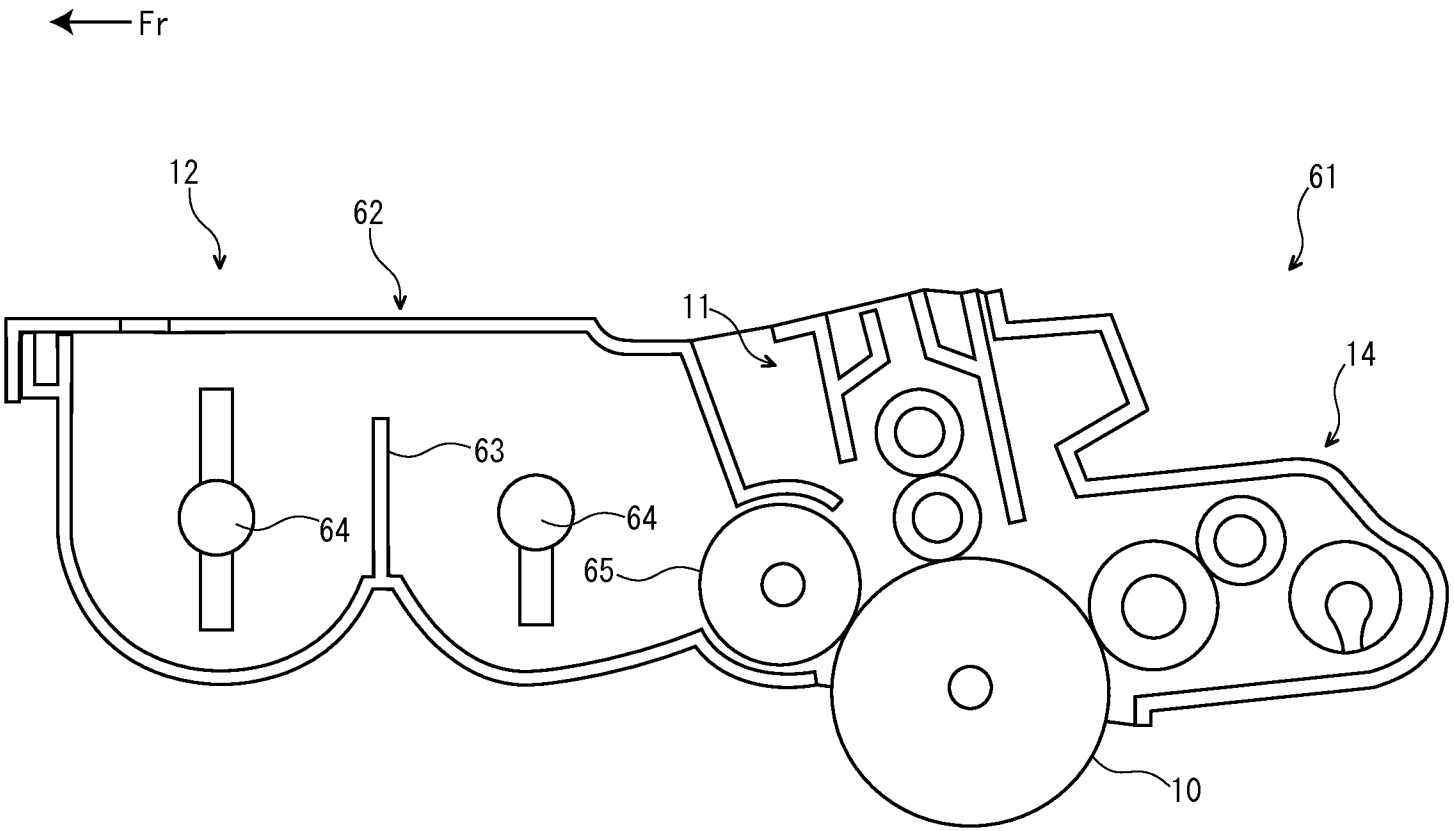
FIG. 5 is a schematic sectional view showing an image forming unit in the printer according to the embodiment of the present disclosure.

As shown in FIG. 4, in a right side part of a front wall 35 of the case main body 22, a restraint depression 36 is hollowed toward the inside (a rear side). In an upper part of a left side part of the restraint depression 36, a lock part 37 is roughly horizontally formed. The position of the lock part 37 may be changed according to an apparatus model of the printer 1.

In a front end part of a left end wall 38 of the case main body 22, a second protruded piece 40 is protruded. In a front part of the second protruded piece 40, a second inclination 41 inclined backward and downward is formed. In a rear part of the left end wall 38 of the case main body 22, a toner filling port 42 is formed and the toner filling port 42 is closed by a cap 43. In front of and below the cap 43, a first bearing 44 is protruded and, in the rear of and below the cap 43, a second bearing 45 is protruded.

In a rear bottom corner of the left end wall 38 of the case main body 22, a first guide protrusion 46 is protruded backward. In a bottom wall (not shown) of the case main body 22, a pair of front and rear supporting pieces 47 are extended in the left and right directions. In the rear of the rear supporting piece 47, a second guide protrusion 48 is protruded. The second guide protrusion 48 is positioned in front of and below the first guide protrusion 46. In a right end part of the bottom wall of the case main body 22, an engaging protrusion 50 is protruded.

The conveying screw 23 is rotatably supported in the case main body 22. As shown in FIG. 3, the conveying screw 23 is formed in an extended-shape in the left and right directions. The conveying screw 23 includes a bar-liked rotation shaft 51 and a spiral fin 52 concentrically formed on the circumference of the rotation shaft 51. A right end part of the rotation shaft 51 is extruded to a right side of the discharge duct 28 and, to this extruded part, a conveying gear 53 is fixed. A left end part of the rotation shaft 51 is pivotally supported by the second bearing 45 (refer to FIG. 4) formed in the left end wall 38 of the case main body 22. The spiral fin 52 is provided roughly over an entire area of the rotation shaft 51. In FIG. 3, a left side part of the spiral fin 52 is shown, but another part is omitted.

The stirring paddle 24 is rotatably supported in the case main body 22. As shown in FIG. 3, the stirring paddle 24 is located in front of and above the conveying screw 23 and formed in an extended-shape in the left and right directions. The stirring paddle 24 includes a frame plate-liked support frame 54 and a sheet-liked stirring vane 55 supported by the support frame 54. To a right end part of the support frame 54, a stirring gear 56 attached to an outside face (a right face) of the right end wall 32 of the case main body 22 is fixed. The stirring gear 56 is meshed with the conveying gear 53. To an outside face of the stirring gear 56, a transmission coupling 57 formed in a roughly triangle-liked shape in a side view is fixed. The transmission coupling 57 is connected to both the conveying screw 23 and stirring paddle 24 as clarified in the above description. A left end part of the support frame 54 is pivotally supported by the first bearing 44 (refer to FIG. 4) formed in the left end wall 38 of the case main body 22.

To a lower end of the covering body 25, a covering body side flange 58 in a correspondent form to the main body side flange 27 of the case main body 22 is formed. The main body side flange 27 and covering body side flange 58 are ultrasonic-welded together so that the case main body 22 and covering body 25 are unified.

As shown in FIG. 3, the shutter 26 is attached so as to cover a lower side of the discharge duct 28 of the case main body 22. To both front and rear parts of the shutter 26, shutter side rails 60 extending in the left and right directions are attached. The shutter side rails 60 engage with the main body side rails 31 attached to the discharge duct 28 of the case main body 22. Thereby, the shutter 26 is configured to slide between a position (refer to a solid line in FIG. 3) to close the discharge port 30 of the case main body 22 and another position (refer to a two-dot chain line in FIG. 3) to open it in the left and right directions.

Next, with reference to FIGS. 5-10, the development device 12 will be described in detail. In FIGS. 6-9B, an arrangement relation in left and right direction on the figure is converse to a realistic arrangement relation in actual left and right direction. That is, the right-hand sides on FIGS. 6-9B are actual left-hand sides and the left-hand sides on FIGS. 6-9B are actual right-hand sides.

As shown in FIG. 5, the development device 12 is integrated with the photosensitive drum 10, charger 11 and cleaning device 14 so that an image forming unit 61 is composed. The development device 12 is provided with a box-formed development device main body 62. At the center inside the development device main body 62, a partition 63 extending in upper and lower directions is formed and, in front of and in rear of the partition 63, stirring members 64 are respectively installed. Each stirring member 64 is rotatably supported in the development device main body 62. Inside the development device main body 62, in rear of and below the rear stirring member 64, a developing roller 65 is installed. The developing roller 65 is rotatably supported in the development device main body 62 and comes into contact with the surface of the photosensitive drum 10.

Figure 6:
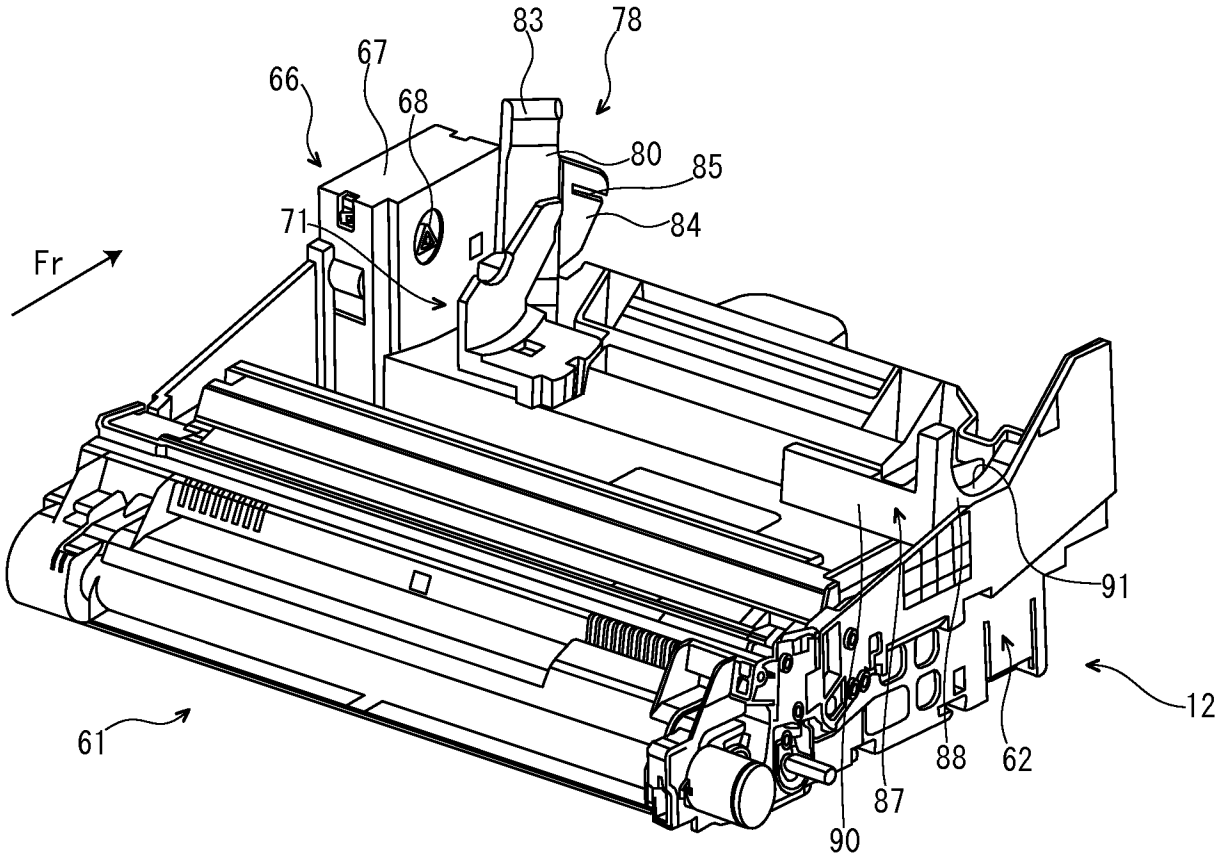
FIG. 6 is a perspective view showing the image forming unit in the printer according to the embodiment of the present disclosure.
Figure 7:
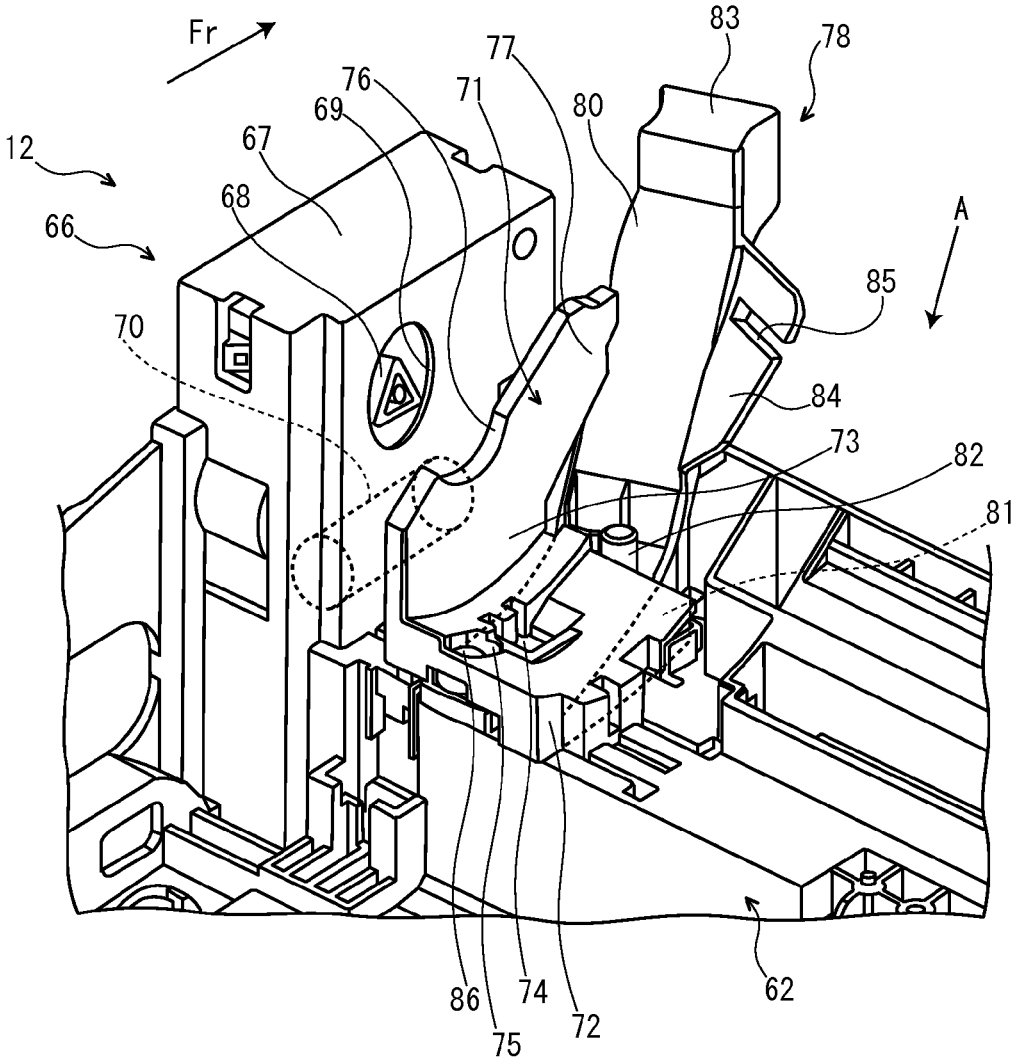
FIG. 7 is a perspective view showing the development device of the printer in a situation, in which a lever is located at a first operation position, according to the embodiment of the present disclosure.
Figure 8:
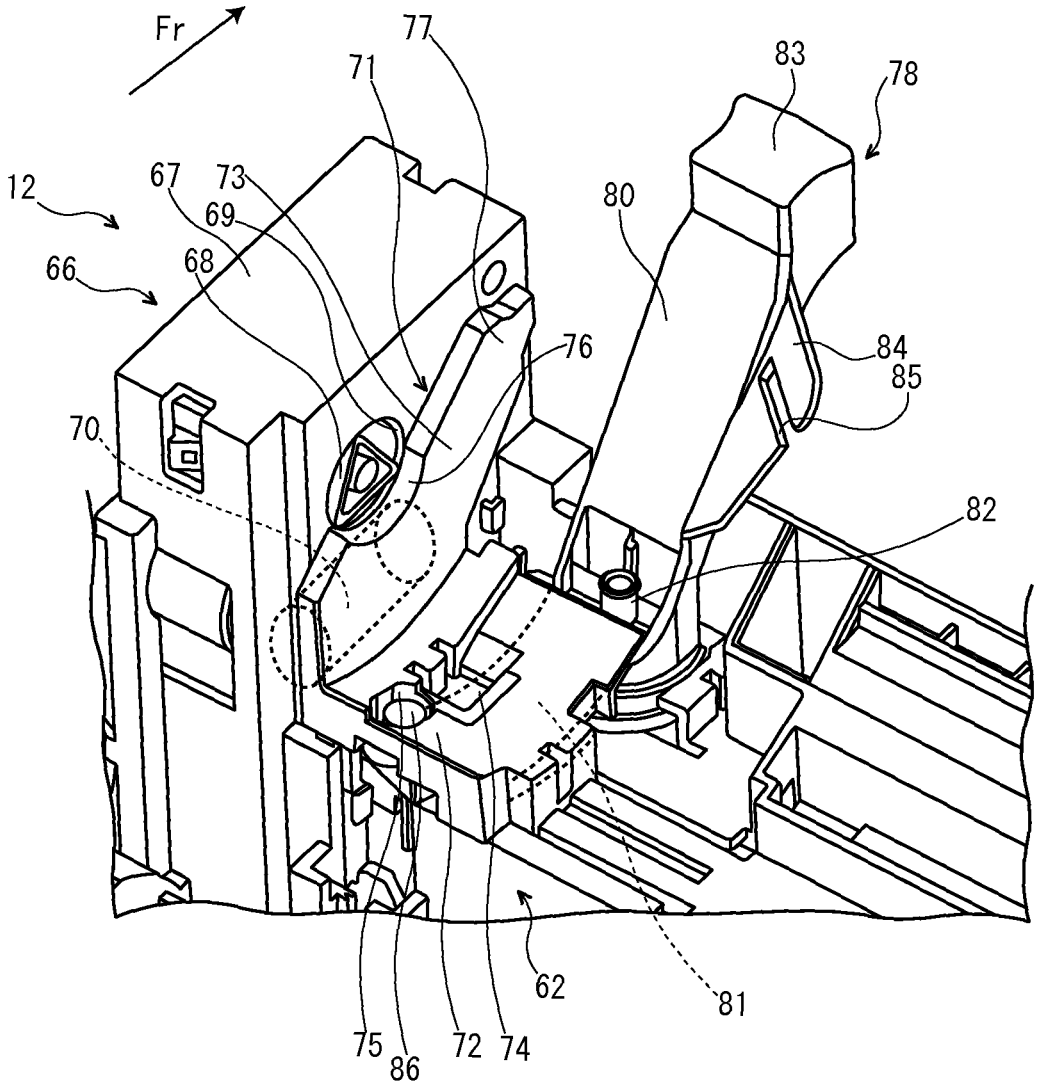
FIG. 8 is another perspective view showing the development device of the printer in another situation, in which the lever is located at a second operation position, according to the embodiment of the present disclosure.

As shown in FIG. 6, to a right end part of an upper face side of the development device main body 62, a driving mechanism 66 is attached. As shown in FIG. 7, the driving mechanism 66 is provided with a box-formed casing 67. In an inside face (a left face) of the casing 67, a circular penetrated hole 69 is formed and, in the penetrated hole 69, a drive coupling is inserted. The drive coupling 68 is formed in a triangle-liked shape in a side view. The drive coupling 68 is connected to a motor (a drive source) 70 installed in the casing 67. The driving mechanism 66 is configured so that, when the motor 70 is driven, a rotation of the motor 70 is transmitted to the drive coupling 68 to rotate the drive coupling 68.

As shown in FIG. 7, to a right side part of the upper face side of the development device main body 62, an advance/retreat member 71 is attached. The advance/retreat member 71 is located at the inside (a left side) of the driving mechanism 66. The advance/retreat member 71 is supported in the development device main body 62 so as to be slidable in the left and right directions. The advance/retreat member 71 is configured to advance and retreat between a first position (refer to FIG. 7) positioned at a predetermined distance from the drive coupling 68 and a second position (refer to FIG. 8) being closer to the drive coupling 68 than the first position.

The advance/retreat member 71 includes a bottom wall part 72 and a side wall part 73 extending upward from a right end of the bottom wall part 72 and is formed in a roughly L-shape in a front view.

In a center of an upper face of the bottom wall part 72, an engaging hole 74 is hollowed downward. In the upper face of the bottom wall part 72 and in the rear of the engaging hole 74, an insertion hole 75 is formed. The insertion hole 75 is formed in a slot-liked shape elongated in forward and backward directions.

An upper edge part of the side wall part 73 is inclined forward and upward. In the upper edge part of the side wall part 73, an arc-liked depression 76 is formed at a correspondent position to the penetrated hole 69 formed in the casing 67 of the driving mechanism 66. Therefore, even if the advance/retreat member 71 slides to the second position, the side wall part 73 does not cover the drive coupling 68 (refer to FIG. 8). In the side wall part 73, an extended part 77 extending forward and upward is provided.

As shown in FIG. 7, to the right side part of the upper face side of the development device main body 62, a lever 78 is attached close to the advance/retreat member 71. The lever 78 includes a first arm (an arm part) 80 inclined backward and downward and a second arm 81 extending backward from a lower end of the first arm 80. In a boundary between the first arm 80 and second arm 81, a pivot part 82 is provided and the lever 78 is configured so as to turn around the pivot 82 in the horizontal direction. Hereinafter, a position (refer to FIG. 7) of the lever 78 when the first arm 80 is inclined at predetermined angles to a right side (a left side on the figure) is called as a first operation position of the lever 78. Another position (refer to FIG. 8) of the lever 78 when the first arm 80 is turned to a left side (a right side on the figure) from the first operation position is called as a second operation position of the lever 78. A further position (refer to FIG. 6) of the lever 78 when the first arm 80 is turned to the right side (the left side on the figure) from the first operation position is called as a third operation position of the lever 78. As clarified in the above description, the third operation position of the lever 78 is opposite to the second operation position in a view of the first operation position.

As shown in FIG. 7, in a state of the lever 78 in the first operation position, the first arm 80 of the lever 78 extends in an attaching direction of the toner container 5 to the development device 12. The attaching direction of the toner container 5 to the development device 12 is a direction (refer to arrow A in FIG. 7) from a front upper side to a rear lower side in the embodiment and, hereinafter, this direction is called as a "attaching direction". In an upper end of the first arm 80 of the lever 78, a roughly rectangular parallelepiped-liked gripper 83 is formed. In a left side part of the first arm 80 of the lever 78, a flat plate-liked restraint protrusion 84 is protruded to a left side. In an upper part of the restraint protrusion 84, a slit-liked lock gap 85 is formed roughly in the horizontal direction. The position of the lock gap 85 may be changed according to an apparatus model of the printer 1.

Figure 9A:
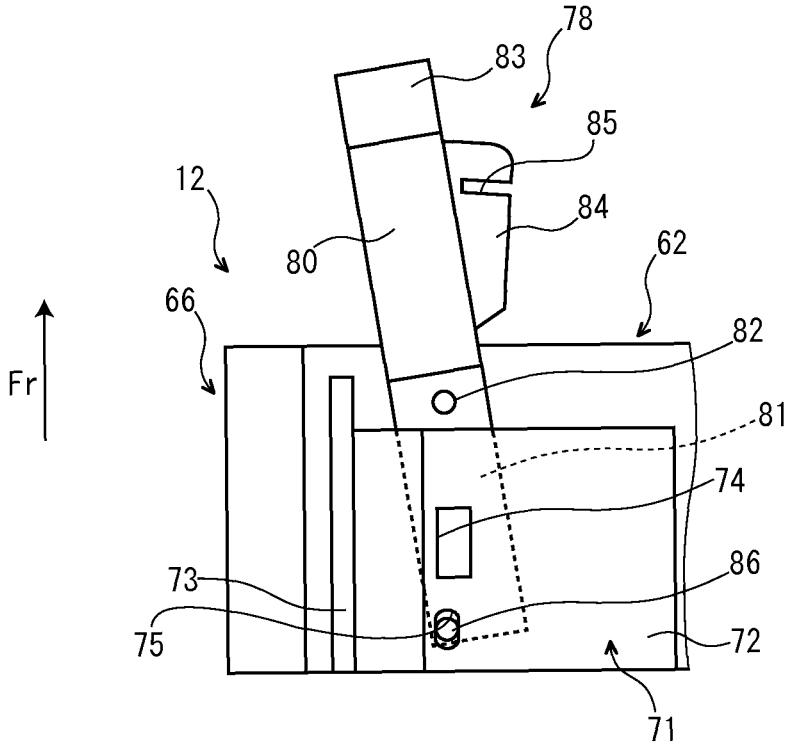
FIG. 9A is a schematic plan view showing the development device of the printer in the situation, in which the lever is located at the first operation position, according to the embodiment of the present disclosure.
Figure 9B:
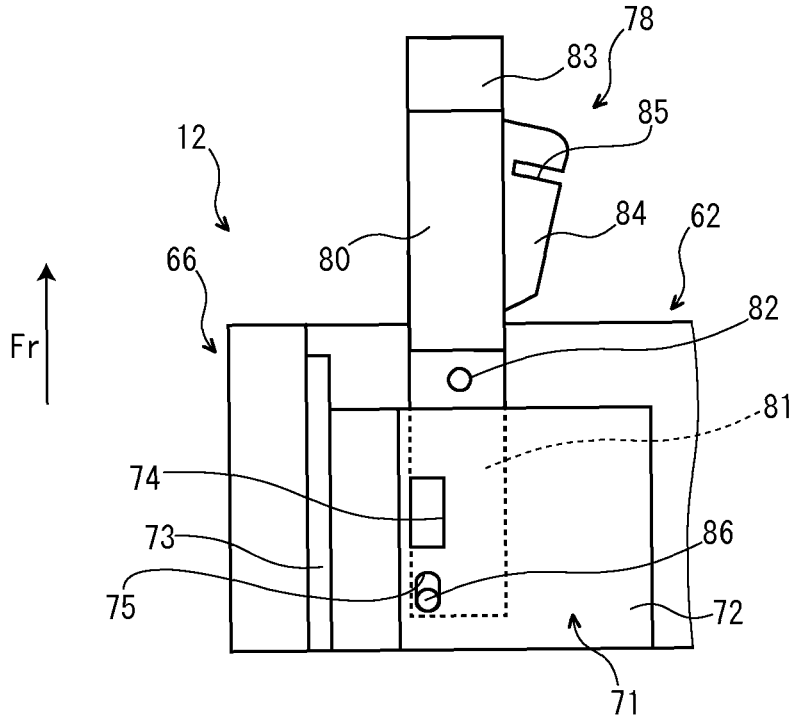
FIG. 9B is another schematic plan view showing the development device of the printer in the other situation, in which the lever is located at the second operation position, according to the embodiment of the present disclosure.

In a top end part (a rear end part) of the second arm 81 the lever 78, a columnar boss 86 is protruded upward. The boss 86 is inserted in the insertion hole 75 formed in the bottom wall part 72 of the advance/retreat member 71. As shown in FIGS. 9A and 9B, when the lever 78 is turned from the first operation position (refer to FIG. 9A) to the second operation position (refer to FIG. 9B), the boss 86 is moved backward in the insertion hole 75, and simultaneously, presses the bottom wall part 72 of the advance/retreat member 71 to the right side (the left side on the figure), thereby the advance/retreat member 71 slides from the first position to the second position. By contrast, when the lever 78 is turned from the second operation position to the first operation position, the boss 86 is moved forward in the insertion hole 75, and simultaneously, presses the bottom wall part 72 of the advance/retreat member 71 to the left side (the right side on the figure), thereby the advance/retreat member 71 slides from the second position to the first position.

Figure 10:
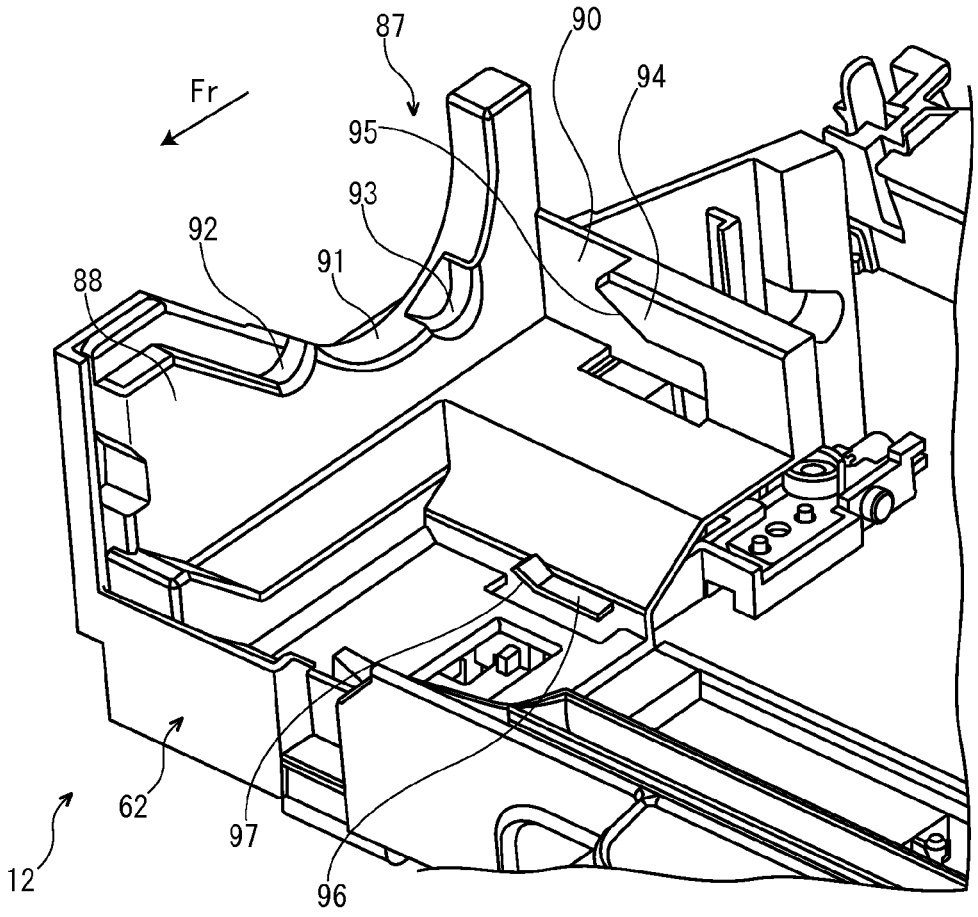
FIG. 10 is a perspective view showing a guide member and the periphery in the development device of the printer according to the embodiment of the present disclosure.

As shown in FIG. 6, in a left end part of the upper face side of the development device main body 62, a guide member 87 is formed. As shown in FIG. 10, the guide member 87 includes a first guide part 88 extending in the forward and backward directions and a second guide part 90 extending from a rear end part of the first guide part 88 to an inside (a right side) and is formed in a roughly L-shape in a plan view.

In an upper edge part of the first guide part 88, a guide depression 91 curved in an arc-liked shape is formed. In a front part and a rear part of the guide depression 91, a first insertion depression 92 and a second insertion depression 93 are respectively formed.

In an inside face (a front face) of the second guide part 90, a first guide piece 94 extending in the left and right directions is formed. In a left end part of the first guide piece 94, a first insertion assistant part 95 inclined to a left and upper side is formed. Therefore, a distance between the left end part of the first guide piece 94 and an upper face of the development device main body 62 gradually increases toward a left side. In front of and below the first guide piece 94, a second guide piece 96 is formed. In a left end part of the second guide piece 96, a second insertion assistant part 97 inclined to a left and upper side is formed. Therefore, a distance between the left end part of the second guide piece 96 and the upper face of the development device main body 62 gradually increases toward a left side.

In the aforementioned configuration, a method of attaching the toner container 5 to the development device 12 will be described mainly with reference to FIGS. 11A-14.

Figure 11B:
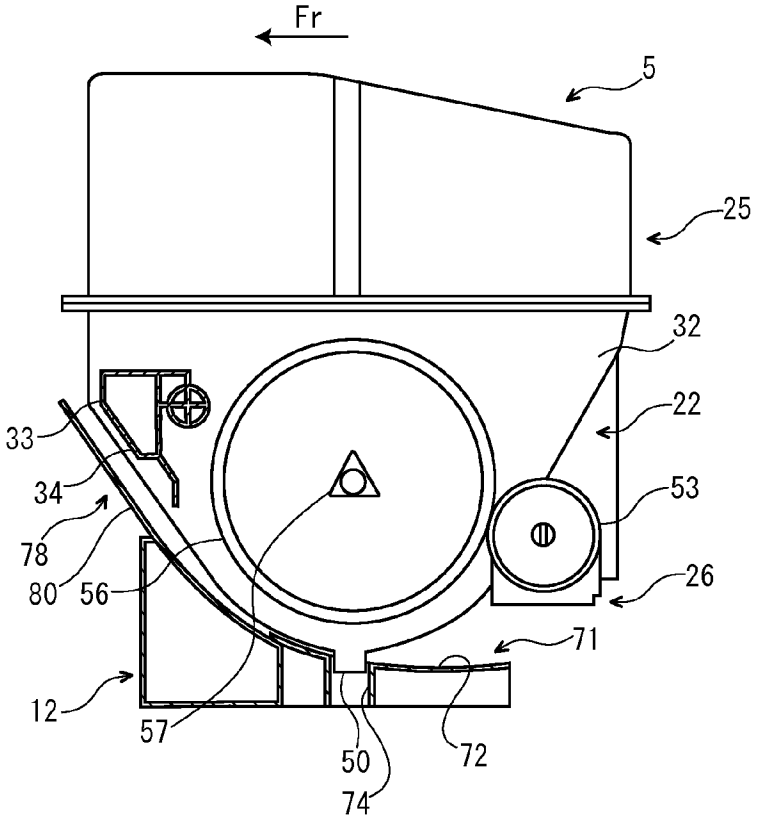
FIG. 11B is another right side view showing the printer in another situation after the toner container is attached to the development device according to the embodiment of the present disclosure.
Figure 11A:
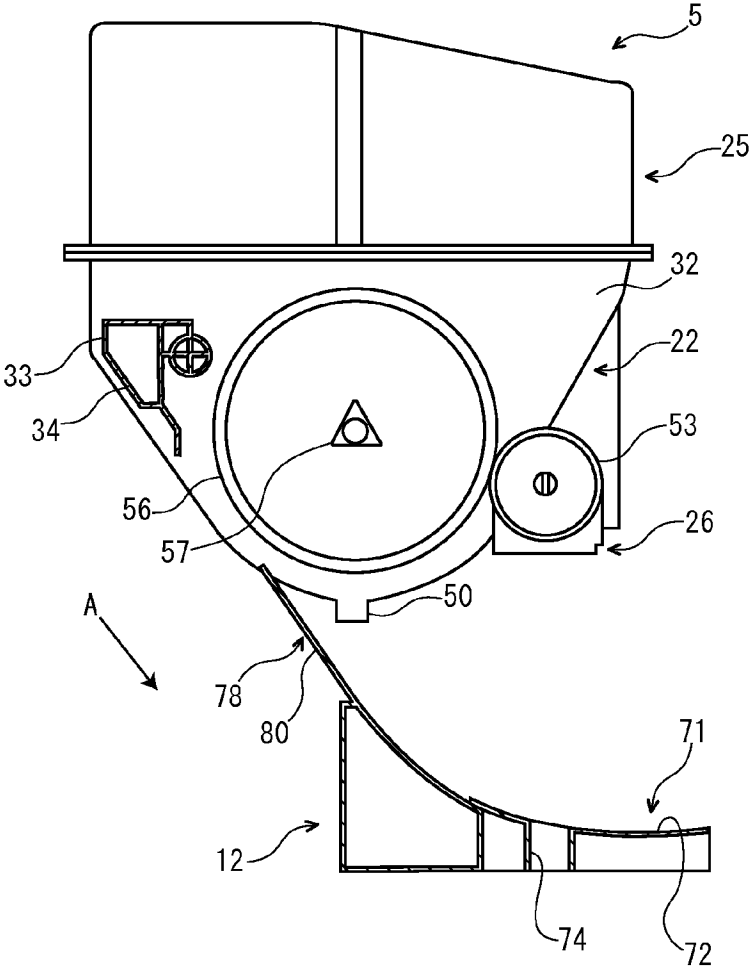
FIG. 11A is a right side view showing the printer in a situation before the toner container is attached to the development device according to the embodiment of the present disclosure.
Figure 12A:
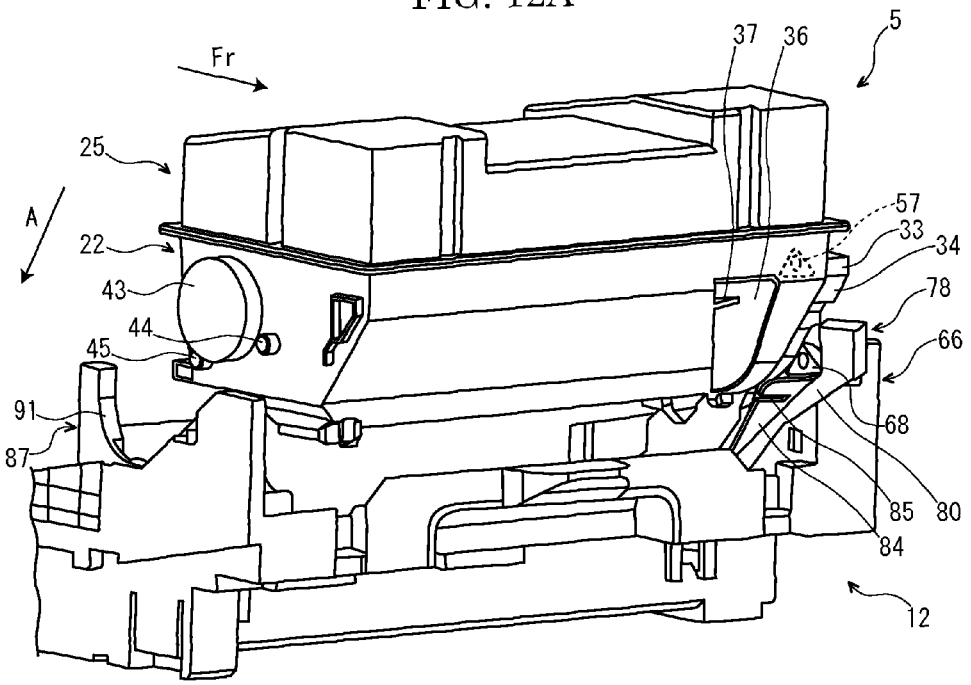
FIG. 12A is a perspective view showing the printer in the situation before the toner container is attached to the development device according to the embodiment of the present disclosure.
Figure 12B:
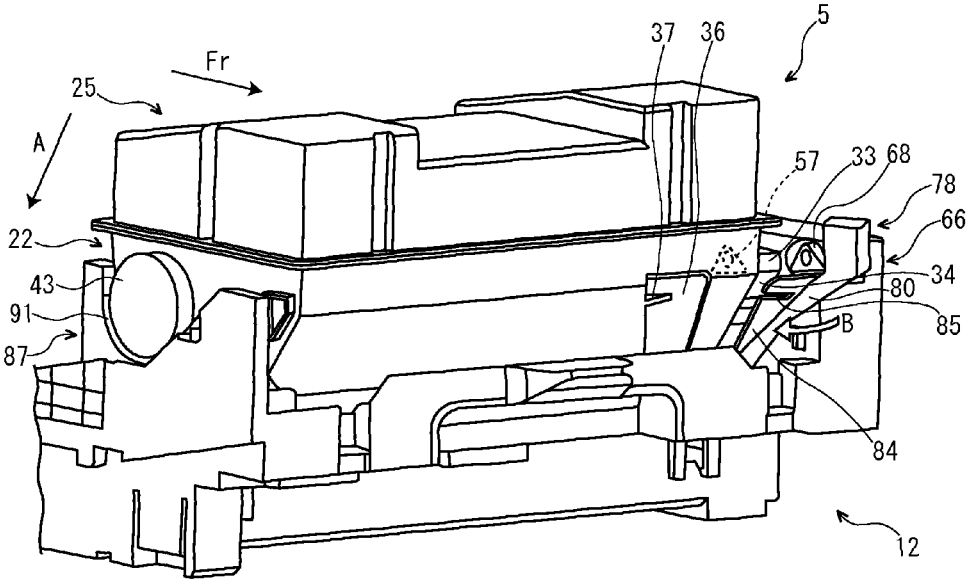
FIG. 12B is another perspective view showing the printer in the other situation after the toner container is attached to the development device according to the embodiment of the present disclosure.

First, as shown in FIGS. 11A and 12A, the toner container 5 is held above the development device 12. Next, as indicated by the arrow A in FIGS. 11A and 12A, the toner container 5 is approached to the development device 12 along the attaching direction, and then, as shown in FIGS. 11B and 12B, the toner container 5 is attached to the development device 12.

At that time, because the first arm 80 of the lever 78 extending in the attaching direction guides the first protruded piece 33 of the toner container 5, it is possible to easily attach the toner container 5 to the development device 12. In addition, because a function as a guide for attaching the toner container 5 to the development device 12 is added to the lever 78, it is possible to make the lever 78 multi-functional. As clarified in the above description, the toner container 5 is attached to the development device 12 along a direction crossing advance and retreat directions (the left and right directions) of the advance/retreat member 71 in the embodiment.

Figure 13A:
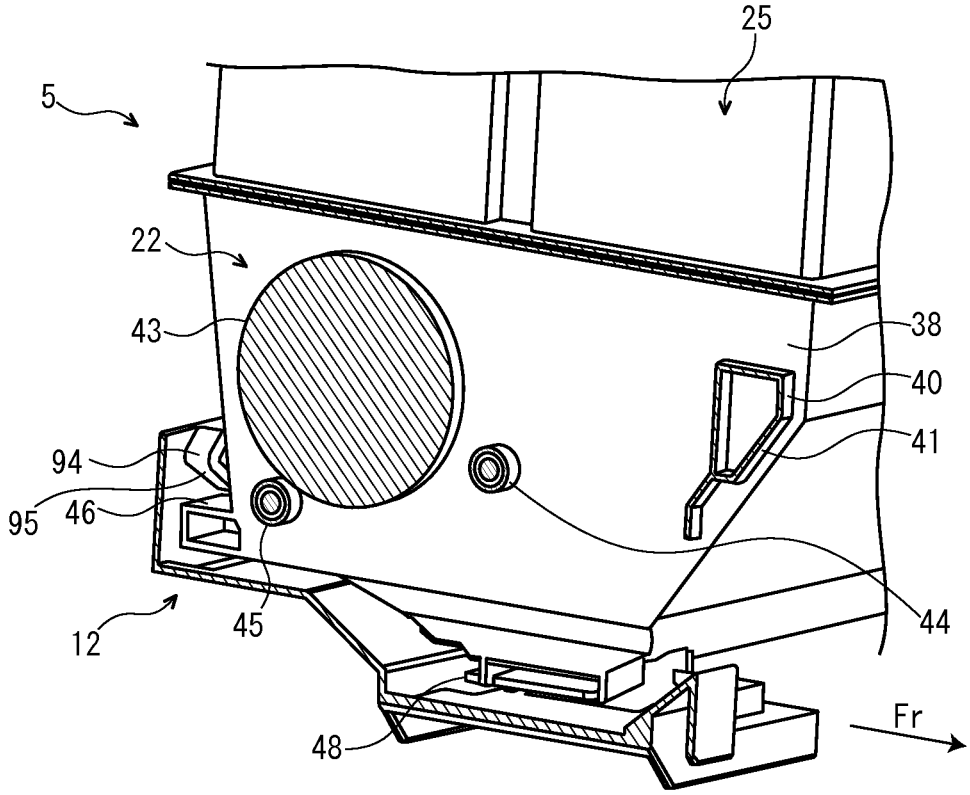
FIG. 13A is a perspective sectional view showing the toner container and development device, when the lever is located at the first operation position, in the printer according to the embodiment of the present disclosure.
Figure 13B:
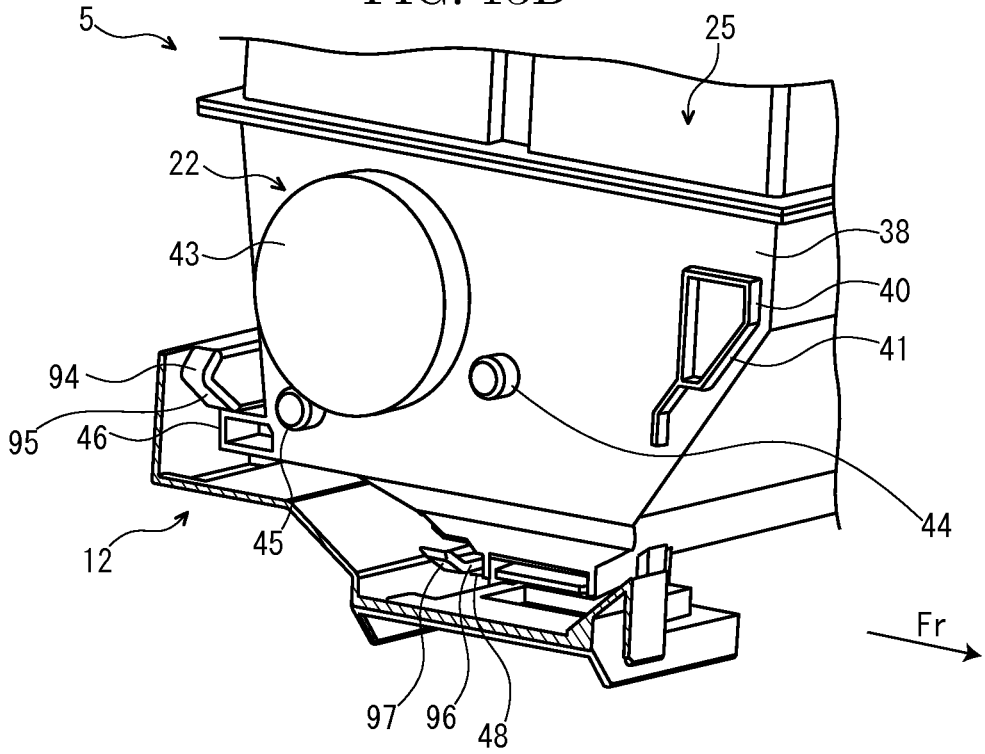
FIG. 13B is another perspective sectional view showing the toner container and development device, when the lever is located at the second operation position, in the printer according to the embodiment of the present disclosure.

As mentioned above, when the toner container 5 is attached to the development device 12, as shown in FIG. 11B, the engaging protrusion 50 of the toner container 5 engages with the engaging hole 74 of the advance/retreat member 71. In addition, as shown in FIG. 12B, the cap 43 of the toner container 5 engages with the guide depression 91 formed in the guide member 87 of the development device 12. Moreover, the first bearing 44 and second bearing 45 of the toner container 5 are respectively inserted in the first insertion depression 92 and second insertion depression 93 (refer to FIG. 10) formed in the guide member 87 of the development device 12. Furthermore, as shown in FIG. 13A, the first guide protrusion 46 of the toner container 5 is moved to a left and lower side of the first guide piece 94 of the development device 12, and simultaneously, the second guide protrusion 48 of the toner container 5 is moved to a left and lower side of the second guide piece 96 (refer to FIG. 10) of the development device 12.

Figure 14:
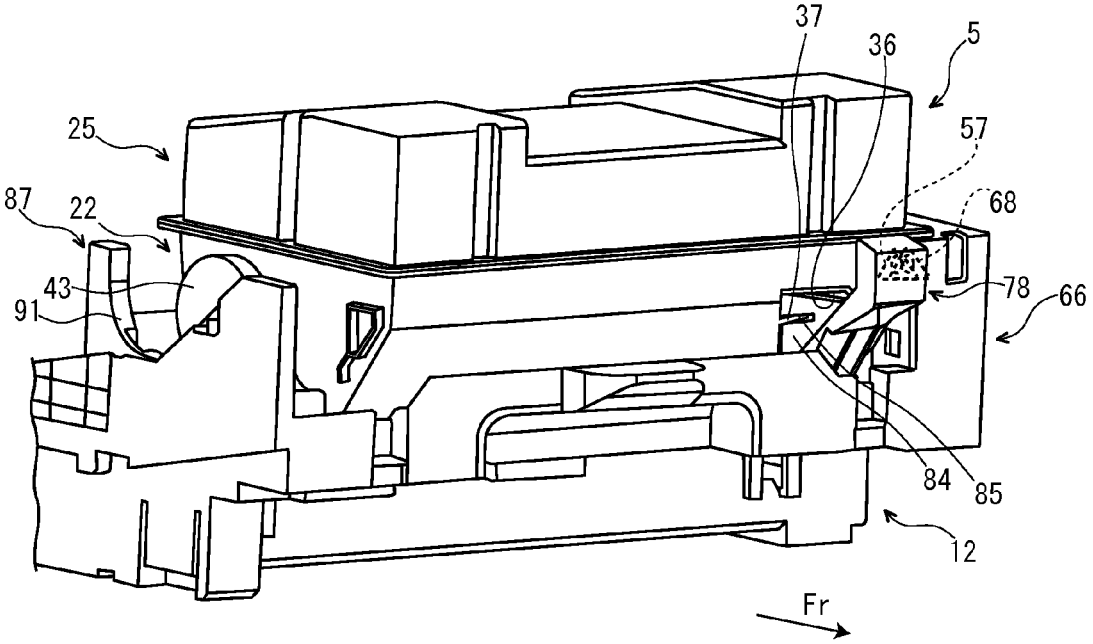
FIG. 14 is a perspective view showing the printer in the other situation, in which the lever is located at the second operation position, according to the embodiment of the present disclosure.

Subsequently, as indicated by a white arrow Bin FIG. 12B, the lever 78 is turned from the first operation position to the second operation position. By this turn, the lever 78 presses the advance/retreat member 71 (not shown in FIG. 12B) and the advance/retreat member 71 slides from the first position to the second position (refer to FIGS. 9A and 9B). Accompanying to this, the toner container 5 slides together with the advance/retreat member 71 in a direction (a right side in the embodiment) approaching to the drive coupling 68, and then, as shown in FIG. 14, the transmission coupling 57 of the toner container 5 is connected to the drive coupling 68 of the development device 12.

Thus, in the embodiment, it is possible to surely connect the transmission coupling 57 to the drive coupling 68 without providing a member for pressing the drive coupling 68 in the toner container 5 and to simplify a configuration of the toner container 5 as consumable. In addition, because the turn of the lever 78 accompanies the pressure of the lever 78 on the advance/retreat member 71, it is possible to change the turn of the lever 78 to the slide of the advance/retreat member 71 by a simple configuration. Moreover, because the turn of the lever 78 accompanies the connection of the transmission coupling 57 to the drive coupling 68, it is possible to decrease a working load of a user and to increase his/her operability.

In addition, when the lever 78 is turned from the first operation position to the second operation position as mentioned above, as shown in FIG. 14, the restraint protrusion 84 of the lever 78 engages with the restraint depression 36 of the toner container 5. Thereby, because a movement of the toner container 5 in a direction (a left side in the embodiment) separating from the drive coupling 68 is restrained, it is possible to surely prevent the connection of the transmission coupling 57 and drive coupling 68 from being carelessly released.

Moreover, accompanying to the engagement of the restraint protrusion 84 of the lever 78 with the restraint depression 36 of the toner container 5 as mentioned above, the lock part 37 of the restraint depression 36 engages with the lock gap 85 of the restraint protrusion 84. Thereby, because a movement of the toner container 5 in a forward and upward direction (to a near side in the attaching direction) is restrained, it is possible to surely keep a state that the toner container 5 is attached to the development device 12.

In the embodiment, particularly, the position of the lock part 37 and position of the lock gap 85 are changed according to an apparatus model of the printer 1. Then, even if another toner container corresponding to another model is attached to the development device 12, another lock part of the other toner container cannot engages with the lock gap 85 and the other lock part interferes with the restraint protrusion 84, and therefore, it is difficult to turn the lever 78 to the second operation position. By applying such a configuration, it is possible to prompt a user to attach the suitable toner container 5 being consistent in the apparatus model to the development device 12 and to prevent the other toner container not being consistent in the apparatus model from being attached in mistake to the development device 12.

Further, when the toner container 5 slides in the direction approaching to the drive coupling 68 as mentioned above, as shown in FIG. 13B, the first guide protrusion 46 of the toner container 5 is moved to a rear and lower side (a far side in the attaching direction) of the first guide piece 94 of the development device 12. In addition, the second guide protrusion 48 of the toner container 5 is moved to a rear and lower side (a far side in the attaching direction) of the second guide piece 96 of the development device 12. Therefore, because the movement of the toner container 5 in the forward and upward direction (to the near side in the attaching direction) is surely restrained, it is possible to more surely keep the state that the toner container 5 is attached to the development device 12.

Furthermore, when the toner container 5 slides in the direction approaching to the drive coupling 68 as mentioned above, the shutter 26 opens the discharge port 30. In such a state that the discharge port 30 is opened, when the motor 70 is driven, the rotation of the motor 70 is transmitted via the drive coupling 68 and transmission coupling 57 to the stirring gear 56, and then, the stirring gear 56 and stirring paddle 24 rotate in a body. Thereby, the toner in the toner container 5 is stirred. In addition, when the stirring gear 56 rotates as mentioned above, this rotation is transmitted via the conveying gear 53 to the conveying screw 23, and then, the conveying screw 23 rotates. Thereby, the toner is discharged from the discharge port 30 and supplied to the development device 12. As mentioned above, in the embodiment, by applying the conveying screw 23 and stirring paddle 24 as rotating members, it is possible to effectively discharge the toner in the toner container 5 from the discharge port 30.

Figure 15A:
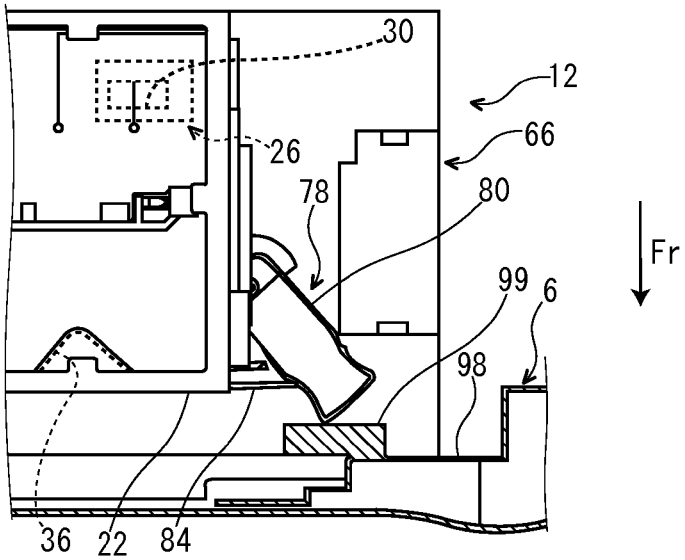
FIG. 15A is a plan sectional view showing the printer in the situation, in which the lever is located at the first operation position, according to the embodiment of the present disclosure.

Next, mainly with reference to FIGS. 15A-15C, the arrangement relation of the lever 78 and upper cover 6 will be described in detail. As shown in FIG. 15A, in a state that the lever 78 is located at the first operation position, the shutter 26 closes the discharge port 30. In such a state of the lever 78 in the first operation position, even if closure of the upper cover 6 is attempted, the first arm 80 of the lever 78 interferes with an interference protrusion 99 formed in a front face part 98 of the upper cover 6, and then, the closure of the upper cover 6 is prevented. Therefore, it is possible to notify the user that the upper cover 6 is closed in mistake while the discharge port 30 is closed by the shutter 26 and to prevent the following mistake operation.

Figure 15B:
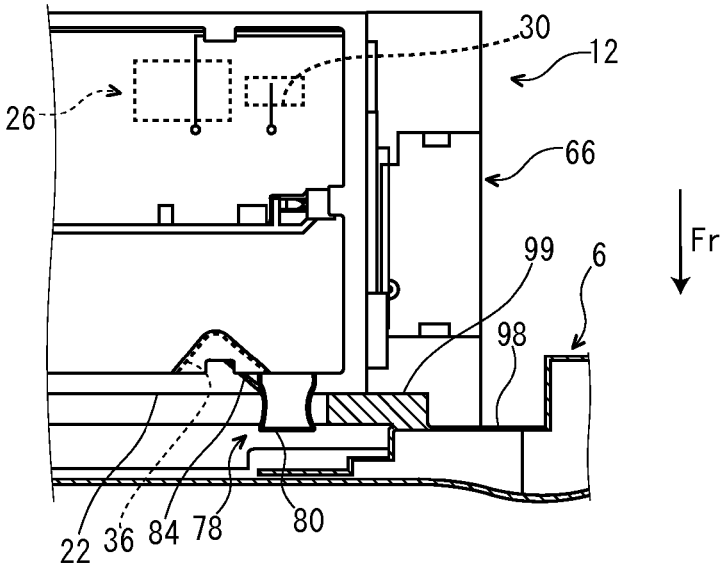
FIG. 15B is another plan sectional view showing the printer in the other situation, in which the lever is located at the second operation position, according to the embodiment of the present disclosure.

On the other hand, when the lever 78 is turned from the first operation position to the second operation position, as shown in FIG. 15B, the shutter 26 opens the discharge port 30. In such a state of the lever 78 in the second operation position, the first arm 80 of the lever 78 does not interfere with the interference protrusion 99 of the upper cover 6. Therefore, it is possible to close the upper cover 6 in a state that the shutter 26 opens the discharge port 30, and then, to carry out the image forming operation.

Figure 15C:
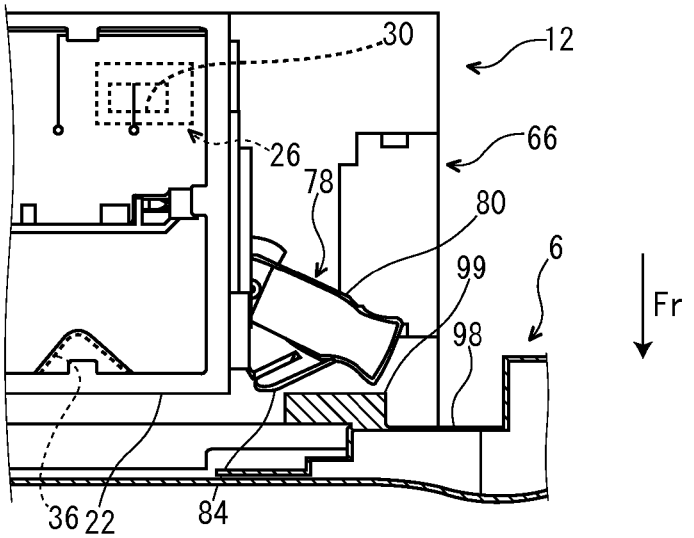
FIG. 15C is a further plan sectional view showing the printer in a further situation, in which the lever is located at a third operation position, according to the embodiment of the present disclosure.

Further, when the printer 1 is shipped, as shown in FIG. 15C, the lever 78 is turned from the first operation position to the third operation position. Even if the lever 78 is turned from the first operation position to the third operation position in this way, a state that the shutter 26 closes the discharge port 30 is kept. In addition, in a state that the lever 78 is located at the third operation position, the first arm 80 of the lever 78 does not interfere with the interference protrusion 99 of the upper cover 6. Therefore, in the state that the shutter 26 closes the discharge port 30, it is possible to close the upper cover 6. Accordingly, it is possible to surely prevent the toner in the toner container 5 from leaking during transportation and to ship the printer 1 in a state that the toner container 5 is installed to the development device 12. Therefore, packing materials for the toner container 5 are unnecessary and it is possible to decrease packing costs.

The embodiment was described about a case where the position of the lock part 37 and position of the lock gap 85 are changed according to an apparatus model of the printer 1. On the other hand, in another embodiment, if the printer 1 uses toners of a plurality of colors for the image forming operation, the positions of the lock part 37 and lock gap 85 maybe changed according to the toner color. Moreover, the positions of the lock part 37 and lock gap 85 may be changed according to a destination of the printer 1.

Although the embodiment applies the development device 12 as the attachment member, another embodiment may apply the printer main body 2 as the attachment member.

Although the embodiment applies the slidable shutter 26, another embodiment may apply another turnable shutter. Although the embodiment applies the turnable lever 78, another embodiment may apply another slidable lever.

Although the embodiment applies the configuration of the present disclosure to the toner container 5, another embodiment may apply the configuration of the present disclosure to another toner case (so-called an "intermediate hopper") interposed between the toner container 5 and development device 12.

Although the embodiment was described in a case where the configuration of the present disclosure are applied to the printer 1, another embodiment may apply the configuration of the disclosure to another image forming apparatus except the printer 1, such as a copying machine, a facsimile or a multifunction machine.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a toner case containing a toner, wherein the toner case includes:

a case main body having a discharge port discharging the toner;

one or more rotating members rotatably installed in the case main body; and a transmission coupling connected to the rotating members; and an attachment member to which the toner case is attachably/detachably installed, wherein the attachment member includes:

a drive coupling connected to a drive source;

an advance/retreat member configured to advance and retreat between a first position positioned at a distance from the drive coupling and a second position being closer to the drive coupling than the first position; and a lever configured to move between a first operation position moving the advance/retreat member to the first position and a second operation position moving the advance/retreat member to the second position, wherein when the toner case is attached to the attachment member, the toner case engages with the advance/retreat member, when the lever is moved from the first operation position to the second operation position in a state that the toner case is attached to the attachment member, the toner case is moved together with the advance/retreat member in a direction approaching to the drive coupling and the transmission coupling is connected to the drive coupling.

2. The image forming apparatus according to claim 1, wherein the lever has an arm part and the arm part is configured to extend in an attaching direction of the toner case to the attachment member in a state that the lever is located at the first operation position.

3. The image forming apparatus according to claim 1, wherein the case main body has a restraint depression, the lever has a restraint protrusion, and when the lever is moved from the first operation position to the second operation position, the restraint protrusion engages with the restraint depression, and then, a movement of the toner case in a direction separating from the drive coupling is restrained.

4. The image forming apparatus according to claim 3, wherein the toner case is configured to be attached to the attachment member along a direction crossing advance and retreat directions of the advance/retreat member, the restraint depression has a lock part, the restraint protrusion has a lock gap, and when the lever is moved from the first operation position to the second operation position, the lock part engages with the lock gap, and then, a movement of the toner case to a near side in an attaching direction is restrained.

5. The image forming apparatus according to claim 4, wherein positions of the lock part and lock gap are changed according to an apparatus model, a toner color or a destination.

6. The image forming apparatus according to claim 1 further comprising an openable/closable cover configured to cover at least a part of an outside face of the toner case, wherein the toner case includes a shutter configured to open and close the discharge port, wherein in a state that the lever is located at the first operation position, the shutter closes the discharge port and the lever interferes with the cover, and in another state that the lever is located at the second operation position, the shutter opens the discharge port and closure of the cover is allowed.

7. The image forming apparatus according to claim 6, wherein the lever is configured to be able to move to a third operation position different from the first operation position and second operation position, and in a further state that the lever is located at the third operation position, the shutter closes the discharge port and the closure of the cover is allowed.

8. The image forming apparatus according to claim 1, wherein the toner case is configured to be attached to the attachment member along a direction crossing advance and retreat directions of the advance/retreat member, the toner case has a guide protrusion, the attachment member has a guide piece, and when the lever is moved from the first operation position to the second operation position in a state that the toner case is attached to the attachment member, the guide protrusion is moved to afar side in an attaching direction of the toner case from the guide piece, and then, a movement of the toner case to a near side in the attaching direction is restrained.

9. The image forming apparatus according to claim 1, wherein the lever is configured to be turnable, the advance/retreat member is configured to be slidable, and when the lever is turned from the first operation position to the second operation position, the lever presses the advance/retreat member, and then, the advance/retreat member slides from the first position to the second position.

10. The image forming apparatus according to claim 1, wherein the rotating members include a stirring paddle stirring the toner contained in the toner case, and a conveying screw discharging the toner stirred by the stirring paddle from the discharge port.

11. A toner case, which contains a toner, is attachably/detachably installed to an attachment member and is installed together with the attachment member in an image forming apparatus, comprising:

a case main body having a discharge port discharging the toner;

one or more rotating members rotatably installed in the case main body; and a transmission coupling connected to the rotating members, wherein the attachment member includes:

a drive coupling connected to a drive source;

an advance/retreat member configured to advance and retreat between a first position positioned at a distance from the drive coupling and a second position being closer to the drive coupling than the first position; and a lever configured to move between a first operation position moving the advance/retreat member to the first position and a second operation position moving the advance/retreat member to the second position, wherein when the toner case is attached to the attachment member, the toner case engages with the advance/retreat member, when the lever is moved from the first operation position to the second operation position in a state that the toner case is attached to the attachment member, the toner case is moved together with the advance/retreat member in a direction approaching to the drive coupling and the transmission coupling is connected to the drive coupling.

12. The toner case according to claim 11, wherein the lever has an arm part and the arm part is configured to extend in an attaching direction of the toner case to the attachment member in a state that the lever is located at the first operation position.

13. The toner case according to claim 11, wherein the case main body has a restraint depression, the lever has a restraint protrusion, and when the lever is moved from the first operation position to the second operation position, the restraint protrusion engages with the restraint depression, and then, a movement of the toner case in a direction separating from the drive coupling is restrained.

14. The toner case according to claim 13, wherein the toner case is configured to be attached to the attachment member along a direction crossing advance and retreat directions of the advance/retreat member, the restraint depression has a lock part, the restraint protrusion has a lock gap, and when the lever is moved from the first operation position to the second operation position, the lock part engages with the lock gap, and then, a movement of the toner case to a near side in an attaching direction is restrained.

15. The toner case according to claim 14, wherein positions of the lock part and lock gap are changed according to an apparatus model, a toner color or a destination.

16. The toner case according to claim 11, further comprising:

a shutter configured to open and close the discharge port, wherein the image forming apparatus further includes an openable/closable cover configured to cover at least a part of an outside face of the toner case, in a state that the lever is located at the first operation position, the shutter closes the discharge port and the lever interferes with the cover, and in another state that the lever is located at the second operation position, the shutter opens the discharge port and closure of the cover is allowed.

17. The toner case according to claim 16, wherein the lever is configured to be able to move to a third operation position different from the first operation position and second operation position, and in a further state that the lever is located at the third operation position, the shutter closes the discharge port and the closure of the cover is allowed.

18. The toner case according to claim 11, further comprising:

a guide protrusion, wherein the toner case is configured to be attached to the attachment member along a direction crossing advance and retreat directions of the advance/retreat member, the attachment member has a guide piece, and when the lever is moved from the first operation position to the second operation position in a state that the toner case is attached to the attachment member, the guide protrusion is moved to afar side in an attaching direction of the toner case from the guide piece, and then, a movement of the toner case to a near side in the attaching direction is restrained.

19. The toner case according to claim 11, wherein the lever is configured to be turnable, the advance/retreat member is configured to be slidable, and when the lever is turned from the first operation position to the second operation position, the lever presses the advance/retreat member, and then, the advance/retreat member slides from the first position to the second position.

20. The toner case according to claim 11, wherein the rotating members include a stirring paddle stirring the toner contained in the toner case, and a conveying screw discharging the toner stirred by the stirring paddle from the discharge port.

* * * * *